United States Patent [19]

Beyrouty

[11] Patent Number: 5,052,319

[45] Date of Patent: Oct. 1, 1991

[54] ON-BOARD EMERGENCY OIL DISPOSAL AND RECOVERY SYSTEM

[76] Inventor: Louis Beyrouty, 88 Robin Dr., Mercerville, N.J. 08619

[21] Appl. No.: 484,811

[22] Filed: Feb. 26, 1990

[51] Int. Cl.[5] ..... B63B 25/08

[52] U.S. Cl. ..... 114/74 T; 114/256; 220/666; 414/137.7

[58] Field of Search ..... 114/74 R, 74 T, 256; 210/242.3; 414/137.1, 137.7; 220/853, 666

[56] References Cited

U.S. PATENT DOCUMENTS

| | | | |
|---|---|---|---|
| 3,354,924 | 11/1967 | Birrell et al. | 220/66 |
| 3,474,844 | 10/1969 | Lindstrom et al. | 220/666 |
| 3,730,307 | 5/1973 | Mitchell | 220/85 B |
| 3,906,880 | 9/1975 | Hebert | 114/68 X |
| 3,993,011 | 11/1976 | Garland | 414/137.7 |
| 4,060,487 | 11/1977 | Samsel | 210/242.3 |
| 4,227,477 | 10/1980 | Preus | 114/74 T X |

*Primary Examiner*—Sherman Basinger

*Attorney, Agent, or Firm*—W. L. Muckelroy; I. Abdallah

[57] ABSTRACT

An on-board oil disposal and recovery system for emergency response to an oil spill comprising one or a plurality of wheeled oil disposal bladders, one or a plurality of bladder support brackets disposed about the periphery of the vessel and means to interconnect the oil transfer system of the vessel and a bladder of the system.

4 Claims, 3 Drawing Sheets

ON-BOARD EMERGENCY OIL DISPOSAL AND RECOVERY SYSTEM

BACKGROUND OF THE INVENTION

The present invention generally relates to means for emergency response to a potential or actual oil spill from an oil transporting vessel. More particularly, the present invention relates to on-board oil spill response means for temporary disposal of the oil cargo of an oil transporting vessel.

Various temporary oil storage means are disclosed in the prior art which are generally towed to the site of an oil spill or positioned at a stationary site in the vicinity of an offshore drilling rig. No on-board temporary oil storage means have been identified by the Applicant suitable for response to a potential or actual oil spill in remote areas. In U.S. Pat. No. 3,779,196 to Knaus et al. an elongated oil storage container is disclosed to provide improved stability of oil storage means when being towed. In U.S. Pat. No. 4,195,951 to Finsterwalder an offshore, bottle-shaped container formed of reinforced or prestressed concrete is disclosed for the temporary storage of oil and the like. U.S. Pat. No. 4,506,623 to Roper et al. discloses a buoyant oil storage vessel comprising a flexible containment bag disposed within a wire rope cage.

SUMMARY OF THE INVENTION

The present invention discloses an on-board oil disposal and recovery system for an oil transporting vessel that includes a collapsible, buoyant and oil impervious bladder that is integrally formed with a portable, wheeled bladder frame, a bladder support bracket that is fixedly attached to a side of the vessel for positioning of the bladder therein before dumping the bladder into the surrounding waters, and means to interconnect the bladder and the oil transfer system of the vessel.

An object of the present invention is to provide oil transporting vessel on-board means for immediate response to a potential or actual oil spill.

Another object of the present invention is to provide portable means for emergency response to a potential or actual oil spill from an oil transporting vessel.

A further object of this invention is to provide means for selective disposal of the oil cargo of an oil transporting vessel.

It is also an object of this invention to provide a recoverable disposal means for the oil cargo of an oil transporting vessel.

Another object of the present invention is to provide an emergency oil disposal system capable of serving as a vessel flotation device.

A further object of the present invention is to provide an oil spill recovery system that can recirculate the oil cargo of an oil transporting vessel totally within a ruptured oil holding tank.

Another object of this invention is to provide means for temporary disposal of the oil cargo of an oil transporting vessel that is not susceptible to weather and ocean conditions or to the availability of off-site rescuers.

It is also an object of the present invention to provide on-board means for temporary disposal of the oil cargo of an oil transporting vessel that is effective in the event that the vessel sinks.

These and other objects and advantages of the present invention will be apparent to those skilled in the art from the follow detail description of a preferred embodiment, drawings and appended claims.

DESCRIPTION OF A PREFERRED EMBODIMENT

Figure 1:
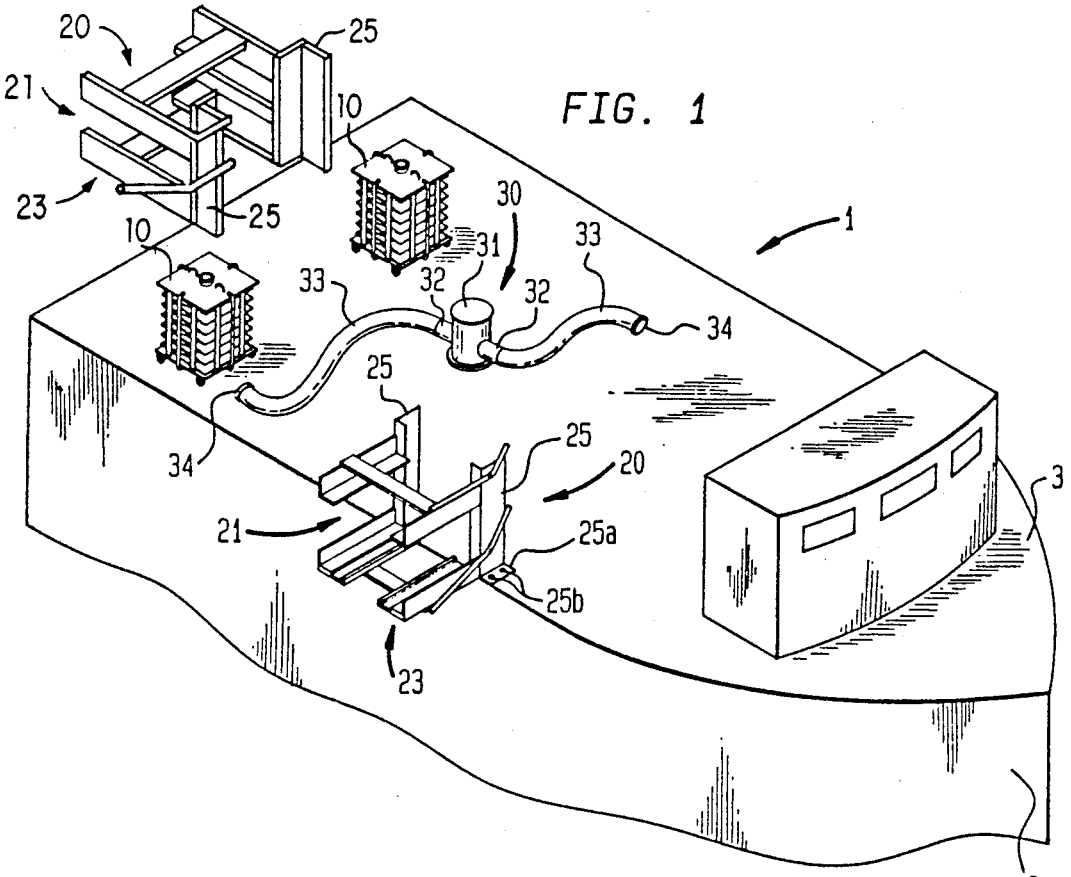
FIG. 1 is a perspective view of an oil transporting vessel equipped with the on-board oil spill recovery system of the present invention.
Figure 2:
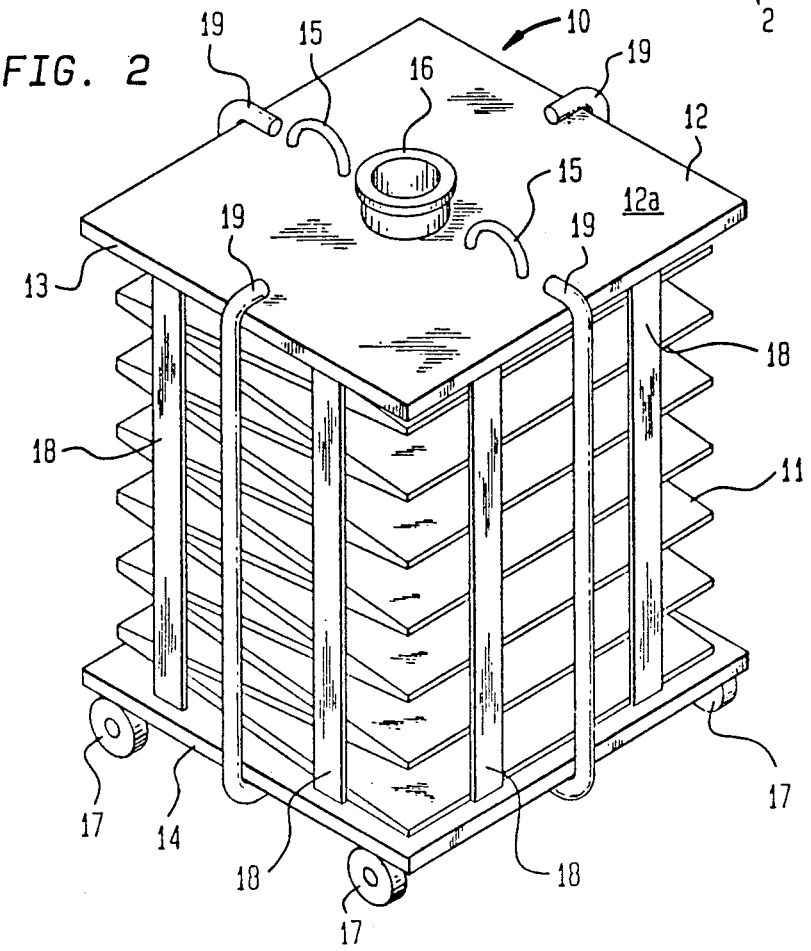
FIG. 2 is an enlarged perspective view of the collapsible bladder of the present invention.

FIG. 1 illustrates in a perspective view the on-board oil spill recovery system 1 of the present invention shown disposed on an oil transporting vessel 2. The oil spill recovery system 1 generally comprises one or a plurality of portable, wheel-mounted, oil impervious bladders 10, one or a plurality of bladder support brackets 20 fixedly attached about the periphery of the vessel 2 and means to interconnect said bladder 10 and the vessel oil transfer system 30. FIG. 2 illustrates an enlarged perspective view of the bladder 10 where it can be seen that bladder 10 comprises a collapsible bag 11, a top plate member 12 integrally formed with a buoyant backing 13 that is fixedly attached to the top of the bag 11, and a bottom plate member 14 fixedly attached to the bottom of the bag 11. Bag 11 is preferably formed from a thin sheet of polyvinylchloride, tyvek, mylar, nylon, hydalon or similar lightweight, buoyant material and is sized for a one million gallon capacity. Top plate member 12 and bottom plate member 14 are preferably formed from a hard metal such as steel or iron and the buoyant backing 13 attached to said top plate member 12 is preferably formed from a 6" thick Styrofoam sheet or similar buoyant material. Cable connectors 15 are fixedly attached to the top surface 12*a* of said top plate member 12 to facilitate handling of the bladder 10 during loading of the bladder 10 onto the vessel 2. A bladder fill port 16, preferably a 4" or larger one-quarter turn STORZ-connect fill port, is disposed between said cable connectors 15 which communicates with the interior of said collapsible bag 11. Bladder 10 further includes casters 17 fixedly attached to the bottom surface of said bottom plate member 14 to facilitate transport of the bladder 10 about the deck 3 of the vessel 2 and for positioning the bladder 10 within the bladder support brackets 20 as hereinafter described in greater detail. Break-away straps or cables 18 extend from said top plate member 12 to said bottom plate member 14 to retain the bag 11 in its collapsed position prior to use. C-shaped shipping clamps 19 are also provided to resist the forces developed on the bladder 10 when said bladder 10 is being loaded onto the vessel. Preferably, said shipping clamps 19 are disposed on all four of the vertical sides of said bladder 10 having the arms 19*a* of said clamps 19 respectively engaging the top surface 12*a* of said top plate member 12 and the bottom surface of said bottom plate member 14. Said clamps 19 are removed once the bladder 10 is loaded onto the vessel 1.

Figure 3:
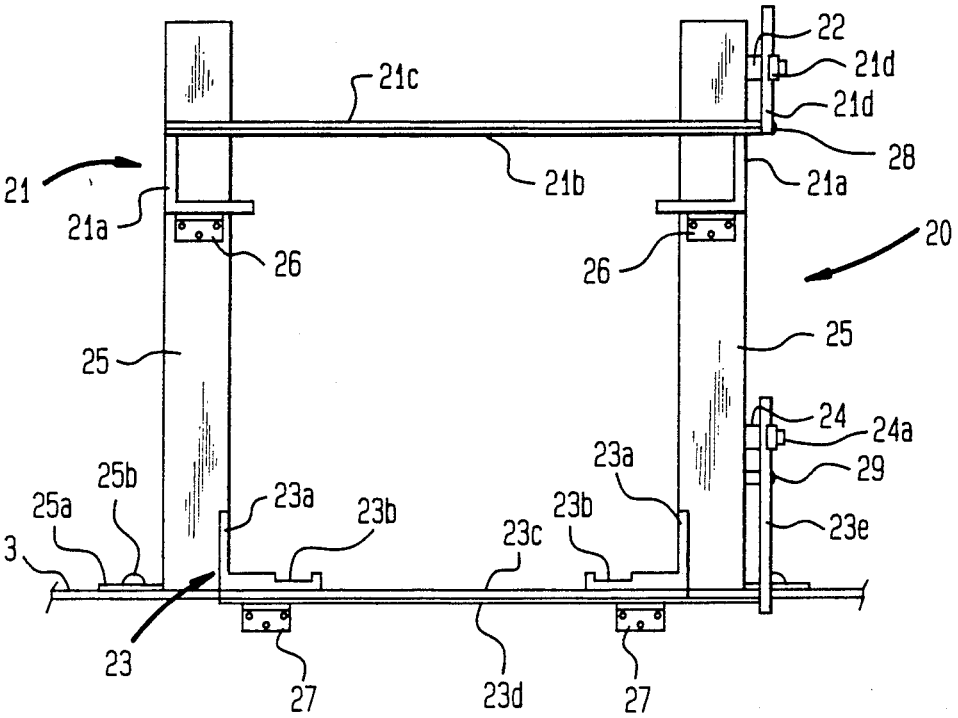
FIG. 3 is a front plan view of the bladder support bracket of the present invention.

FIG. 3 illustrates a front plan view of the bladder support bracket 20 of the present invention. Bladder support bracket 20 generally comprises a plurality of plates and angles attached to each other and to the side of the vessel 2. An upper framed platform 21 is formed by a pair of L-shaped upper angles 21*a* which extend horizontally from said vessel 2 and are interconnected by means of an upper frame plate 21*b* fixedly attached to the respective top edges of the vertical legs of said upper angles 21*a*. Said upper frame plate 21*b* is disposed approximately one-third of the length of said upper angles 21*a* as measured from the distal end of said upper angles 21*a* (FIG. 1). An upper platform lever rod 21*c* is fixedly attached to the top surface of the upper frame plate 21*b* and extends laterally having an end of said upper platform lever rod 21 extending beyond said upper frame plate 21*b*. The upper frame platform 21 is hingedly attached by hinge means 26 to a pair of frame support members 25 comprising L shaped angles vertically disposed in spaced relationship at the edge of the vessel 2. Said frame support members 25 include a lower flange 25*a* through which the respective frame support members 25 are fixedly attached to the deck 3 of the vessel 2 by bolt means 25*b* or other suitable fixedly attachable means. A lower frame platform 23 is formed by a pair of lower L-shaped angles 23*a* which extend horizontally from said vessel 2 and are interconnected by means of an lower frame plate 23*c* fixedly attached to the bottom surface of the respective horizontal legs of said lower angles 21*a*. Said lower frame plate 23*c* is disposed approximately one third of the length of said lower angles 23*a* as measured from the distal end of said lower angles 23*a* (FIG. 1). A lower platform lever rod 23*d* is fixedly attached to the bottom surface of the lower frame plate 23*c* and extends laterally having an end of said lower platform lever rod 21 extending beyond said lower frame plate 23*c*. The lower frame platform 23 is hingedly attached by hinge means 27 to the side of vessel 2. The lower angles 23 are formed having a longitudinal slot 23*b* extending for the length of said lower angles 21 to facilitate positioning of the bladder 10 in said bracket 20. The bottom of said slots 23*b* are horizontally aligned with the deck 3 of the vessel 2 so that the bladder 10 can be easily rolled from the deck 3 into the bracket 20. The longitudinal slots 23*b* of the lower angles 23 of said bracket 20 are sized so that the casters 17 of said bladder easily engage said slots 21*a* and facilitate alignment of said bladder 10 in said bracket 20.

Figure 4:
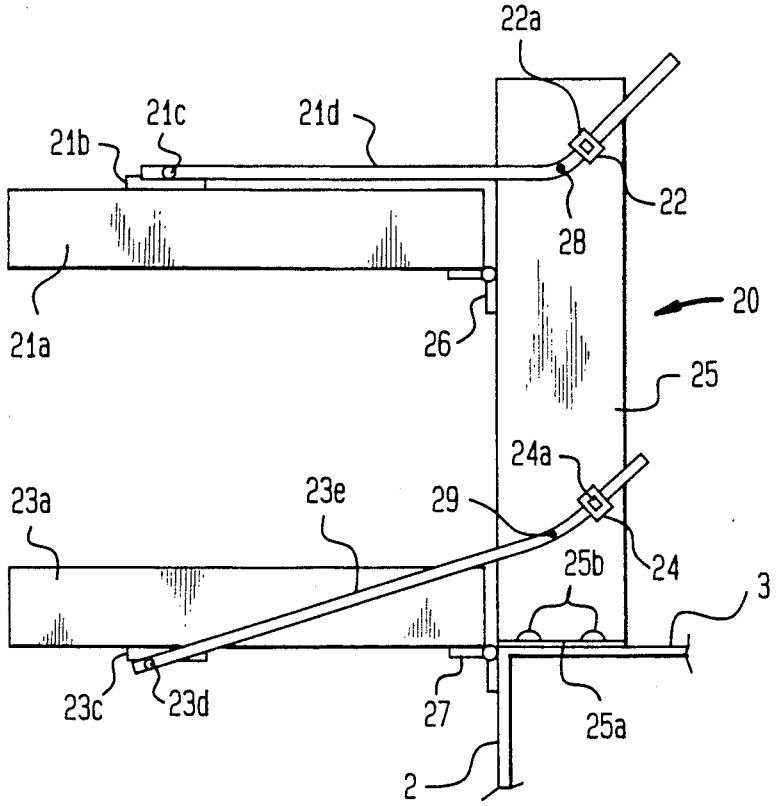
FIG. 4 is a side plan view of the bladder support bracket of the present invention.

Referring now to FIGS. 3 and 4 it can be seen that the hinged movement of said upper frame platform 21 and said lower frame platform 23 is selectively operable by means of respective upper and lower levers 21*d*, 23*e*. The distal end of said upper lever 21*d* rotatably engages the end of said upper lever rod 21*c* that extends beyond said upper platform plate 21*b*. An upper pivot 28 engages the upper lever 21*d* proximate to its midpoint for pivotal rotation of the upper lever 21*d* and thereby provides means to selectively move said upper frame platform 21 about the upper hinge means 26. An upper lever locking clamp 22 is hingedly attached to the side of a frame support member 25 to provide means to selectively lock the upper lever 21*d* and thereby lock the upper frame platform 21 in its upright position. Said locking clamp 22 includes a finger ring 22*a* to facilitate movement of said locking clamp 22. The distal end of said lower lever 23*e* rotatably engages the end of said lower lever rod 23*d* that extends beyond said lower platform plate 23*c*. A lower pivot 29 engages the lower lever 23*e* proximate to its midpoint for pivotal rotation of the lower lever 23*e* and thereby provides means to selectively move said lower frame platform 23 about the lower hinge means 27. A lower lever locking clamp 24 is hingedly attached to the side of a frame support member 25 to provide means to selectively lock the lower lever 23*e* and thereby lock the lower frame platform 23 in its upright position. Said lower locking clamp 24 includes a finger ring 24*a* to facilitate movement of said locking clamp 22.

As can be seen in FIG. 1 the means to interconnect the bladder and the oil transfer system 30 generally comprises a pumping means 31 having one or a plurality of oil ports 32 which can be attached to a length of flexible tubing 33. Said flexible tubing 33 further includes bladder connection means 34 at the distal end of said tubing 33.

Figure 5:
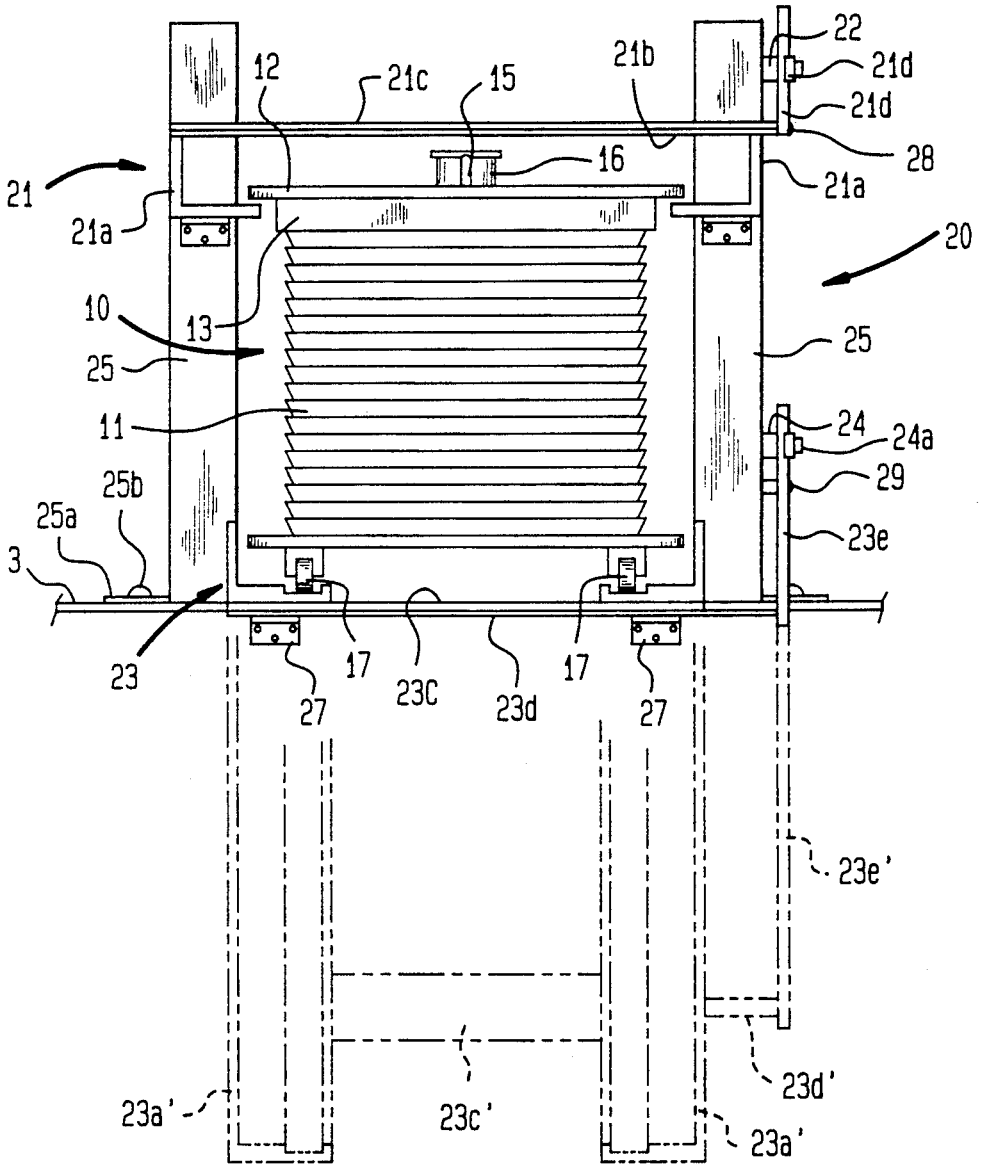
FIG. 5 is a front plan view of the bladder support bracket having the bladder disposed therein.

Referring now to FIG. 5 there is shown a front plan view of the support bracket 20 having a bladder 10 disposed therein. When the bladder 10 is placed into the support bracket 20 the side edges of the top plate member 12 of the bladder 10 are disposed adjacently above the horizontal legs of the upper angles 21*a* with bladder fill port 16 disposed below the upper frame plate 21*b* of said upper frame platform 21. The casters 17 of the bladder 10 engage the longitudinal slots 23.

From the foregoing description operation of the present invention can be easily understood. In the event of an oil spill the bladder 10 is rolled into the bracket 20. The lower locking clamp 24 is manually removed from said lower lever 23*e* and lower frame platform 23 is lowered by operation of the lower lever 23*e* as indicated by the phantom lines shown in FIG. 5. Thereby the bladder 10 is disposed into the surrounding waters having the top plate member 12 of the bladder 10 bearing upon the upper angles 21*a* of the upper frame platform 21. The flexible tubing 33 is then is attached to the bladder fill port 16 by means of said bladder connection means 34 and oil is then transferred to the bladder 10. When the bladder 10 is filled or the spill is halted the upper frame platform 21 is lowered by operation of the upper lever 21*d* and thereby the bladder 10 is dumped into the surrounding waters. Another bladder 10 can likewise be filled and dumped into the surrounding waters. Means to interconnect bladders 10 prior to dumping into the surrounding waters can be conveniently located near the bladder bracket 20. The number of wheeled bladders 10 to be included on-board the vessel 2 can be determined by the capacity of the oil transporting vessel 2.

Alternatively the oil disposal and recovery system 1 of the present invention can be utilized on board the vessel 2 by dumping the bladder 10 into a ruptured holding tank thereby permitting the stored oil to be recirculated to a closed container on the vessel 2 thereby eliminating recovery operations. In the event that the vessel 2 is in danger of sinking the filled bladders 10 can be tied to the vessel 2 to serve as a flotation devices to keep the damaged vessel 2 afloat. Also the oil load can be temporarily disposed utilizing the system 1 of the present invention to facilitate freeing of a grounded vessel.

Various changes and modifications may be made to the present invention without departing from its spirit and scope and such changes and modifications are intended to be included in the invention as held in the appended claims.

Therefore, in view of the foregoing I claim:

1. An on-board emergency oil disposal and recovery system for an oil transporting vessel having an oil transfer system comprising:

a collapsible bag formed with a top and a bottom having a top plate member integrally formed with a buoyant backing and fixedly attached to the top of said bag and a bottom plate member fixedly attached to the bottom of said bag, said top plate member having at least one cable connector fixedly attached to a top surface of said top plate member and a bladder fill port which communicates with the interior of said bag, said bottom plate member having a plurality of casters fixedly attached to a bottom surface of said bottom plate member;

a bag support bracket fixedly attached to the periphery of said vessel comprising a framed member having hingedly attached upper and lower bladder support frame members, said upper frame member being disposed to receive the top plate member of said bladder in bearing engagement and said lower frame member being formed with longitudinal slots for receipt of the casters of said bladder in rolling engagement, the hinged movement of said upper frame member being selectively operable by an upper lever and the hinged movement of said lower frame member being selectively operable by a lower lever; and means to interconnect the oil transfer system of said vessel and the bladder fill port of said bladder, said interconnecting means including means to pump oil from said oil transfer system to said bladder.

2. An on-board oil disposal and recovery system as described in claim 1 wherein said bag is formed from a thin sheet of lightweight, buoyant material.

3. An on-board oil disposal and recovery system as described in claim 1 wherein said bag is sized for one million gallon capacity.

4. An on-board oil disposal and recovery system as described in claim 1 wherein said fill port is a 4" or larger one-quarter turn STORZ-connect fill port.

* * * * *